US010550667B2

(12) United States Patent
Rushing et al.

(10) Patent No.: US 10,550,667 B2
(45) Date of Patent: Feb. 4, 2020

(54) ISOLATION VALVE ASSEMBLY

(71) Applicant: CNPC USA Corp., Houston, TX (US)

(72) Inventors: Anthony Rushing, Humble, TX (US); Anthony Tran, Kemah, TX (US)

(73) Assignee: CNPC USA Corp., Houston, TX (US)

( * ) Notice: Subject to any disclaimer, the term of this patent is extended or adjusted under 35 U.S.C. 154(b) by 187 days.

(21) Appl. No.: 15/791,046

(22) Filed: Oct. 23, 2017

(65) Prior Publication Data

US 2019/0120016 A1 Apr. 25, 2019

(51) Int. Cl.
*E21B 34/14* (2006.01)
*E21B 34/00* (2006.01)

(52) U.S. Cl.
CPC ..... *E21B 34/14* (2013.01); *E21B 2034/002* (2013.01)

(58) Field of Classification Search
CPC .... E21B 2034/002; E21B 34/14; E21B 34/10; E21B 34/102; E21B 34/103; E21B 34/125
See application file for complete search history.

(56) References Cited

U.S. PATENT DOCUMENTS 3,007,669 A * 11/1961 Fredd ..... E21B 34/10 137/505.47
3,035,808 A * 5/1962 Knox ..... E21B 34/10 137/458
3,189,044 A * 6/1965 Sizer ..... E21B 34/08 137/498
3,703,193 A * 11/1972 Raulins ..... E21B 34/101 137/630
3,750,751 A 8/1973 Mott
3,826,462 A * 7/1974 Taylor ..... E21B 34/101 251/58
3,830,297 A 8/1974 Cockrell
3,971,438 A 7/1976 Crowe
3,993,136 A * 11/1976 Mott ..... E21B 34/101 166/375
4,062,406 A 12/1977 Akkerman et al.
4,074,761 A * 2/1978 Mott ..... E21B 21/10 137/496
4,378,931 A 4/1983 Adams, Jr.
4,421,171 A * 12/1983 Haynes ..... E21B 34/12 166/330
4,475,598 A * 10/1984 Brakhage, Jr. ..... E21B 34/10 166/321
4,550,780 A 11/1985 Mott
(Continued)

*Primary Examiner* — Blake E Michener
(74) *Attorney, Agent, or Firm* — Craft Chu PLLC; Andrew W. Chu

(57) ABSTRACT

The isolation valve assembly includes a ball member stabilized relative to a ceramic ring, an upper ball housing and a lower ball seat with a set of shifting bars, a set of locking bars, and a set of supporting bars. The shifting bars rotate the ball member between opened and closed configurations, while the locking bars and supporting bars stabilize the ball member. The supporting bars are off set from the shifting bars and locking bars, and the supporting bars are anchored to the assembly separate from the locking bars and shifting bars. The actuation of the shifting bars is independent from the locking bars and the supporting bars so that the ball member can be held in the opened or closed configuration with more stability.

20 Claims, 5 Drawing Sheets

(56) References Cited

U.S. PATENT DOCUMENTS

| | | | | |
|---|---|---|---|---|
| 4,712,613 | A * | 12/1987 | Nieuwstad | E21B 21/10 166/53 |
| 5,050,839 | A * | 9/1991 | Dickson | E21B 29/04 166/324 |
| 5,551,665 | A * | 9/1996 | Noack | E21B 29/04 166/324 |
| 6,662,886 | B2 | 12/2003 | Russell | |
| 2012/0018172 | A1* | 1/2012 | Javed | E21B 34/14 166/382 |
| 2013/0214189 | A1* | 8/2013 | Natarajan | F16K 5/0647 251/315.08 |
| 2014/0374120 | A1* | 12/2014 | Vlielander | E21B 33/127 166/375 |
| 2017/0122070 | A1 | 5/2017 | McNeilly et al. | |
| 2017/0234109 | A1* | 8/2017 | Smith | E21B 34/14 166/331 |

* cited by examiner

ISOLATION VALVE ASSEMBLY

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a downhole tool for isolating zones in a wellbore. Even more particularly, the present invention relates to an isolation valve assembly.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone. An isolation valve creates a barrier between two zones, such as a seal between a production zone and a non-productive zone. The production fluids can be delivered to the production zone and not the non-productive zone. A ball is a very conventional mechanical component for an isolation valve. The ball forms the physical barrier between the zones, and this type of isolation valve is an isolation ball valve.

For the isolation ball valve, the rotation of the ball determines whether a seal is formed as the barrier between zones. The ball rotates to form the seal and rotates to break the seal to control the separation and isolation of zones.

Thus, the ball must be locked in place so that the ball can maintain the seal and isolation or maintain the broken seal so that the isolation is released and fluids can pass between the zones. An isolation valve may be actuated between opened and closed configurations as production fluids are delivered to a particular production zone with the isolation valve closed and sealed and as productions fluids are delivered to other production zones further down the wellbore with the isolation valve opened.

Stability of the ball determines the strength and reliability of the barrier between zones. Several downhole system have developed means for increasing this stability. A lock bar is a known component to stabilize the position of the ball. U.S. Pat. No. 3,971,438, issued on 27 Jul. 1976 to Crowe, relies on a bar with connections to ball for setting position of the ball. U.S. Pat. No. 3,750,751, issued on 7 Aug. 1973 to Mott, also describes a ball valve with a bar member as the actuator. U.S. Pat. No. 4,062,406, issued on 13 Dec. 1977 to Akkerman et al., shows the lock bar with pin engagement to the ball and an opposite end for connection to another component. Movement of the lock bar controls the position of the ball and holds the ball in either position. U.S. Pat. No. 6,662,886, issued on 16 Dec. 2003 to Russell, also shows a lock bar with one end connected to the ball and another end connected to an actuator to control opened and closed configurations of the valve.

Other structures have been used to actuate the ball of an isolation valve. U.S. Pat. No. 4,550,780, issued on 5 Nov. 1985 to Mott, shows a system with a set of lock bars for the actuation of the ball. Two lock bars actuate the ball from two sides of the ball. U.S. Pat. No. 3,830,297, issued on 20 Aug. 1974 to Cockrell, shows a spring-based system with a sleeve. The spring presses the sleeve to engage the ball. A pin in the sleeve actuates the ball to rotate between opened and closed configurations. U.S. Pat. No. 4,378,931, issued on 3 Jun. 1980 to Adams Jr., discloses a ribbed sleeve with a plurality of ribs. The ribs engage slots in the ball to control rotation of the ball and to hold position of the ball. US Publication No. 20170122070, issued on 4 May 2017 to McNeilly et al., discloses a collet type structure to engage the ball. Fingers of the collet narrow to lock the position of the ball.

It is an object of the present invention to provide an isolation valve assembly for separating zones in a wellbore.

It is an object of the present invention to provide an isolation valve assembly with a ball component rotating between a closed configuration and an opened configuration.

It is an object of the present invention to provide an isolation valve assembly with a ball component with a means to lock rotation of the ball component in either the closed configuration or the opened configuration.

It is another object of the present invention to provide an isolation valve assembly with locking bars and shifting bars on both sides of the ball component.

It is another object of the present invention to provide an isolation valve assembly with locking bars on both sides of the ball component and supporting bars on offset sides of the ball component.

It is still another object of the present invention to provide an isolation valve assembly with shifting bars anchored separate from the supporting bars.

These and other objectives and advantages of the present invention will become apparent from a reading of the attached specification.

BRIEF SUMMARY OF THE INVENTION

Embodiments of the isolation valve assembly, according to the present invention, include a lower housing, a transition sleeve extending out of the second lower housing, a bottom housing engaging the lower housing with the transition sleeve extending into the bottom housing, and a connector sleeve being positioned within the bottom housing and engaging the transition sleeve. Longitudinal movement of the connector sleeve along the axis of the assembly corresponds to longitudinal movement of the transition sleeve. The invention further includes an upper ball housing engaging the connector sleeve, a ceramic ring engaging the upper ball housing, a lower ball seat, and a ball member between the ceramic ring and the lower ball seat. The ball member has a first ball member position corresponding to a closed configuration with the ball member in a sealed relationship to the ceramic ring, and a second ball member position corresponding to an opened configuration with the ball member in fluid connection with the ceramic ring. The ball member rotates between the first ball member position and the second ball member position, according to shifting pins on lateral sides of the ball member.

Embodiments of the present invention include the shifting pins being actuated by respective first and second shifting bars. The anchor ends of the shifting bars fixedly attach to the connector sleeve so that the shifting bars move with the connector sleeve and transition sleeve. Thus, the ball member rotates according to movement of the connector sleeve and transition sleeve. There are locking bars fixed to the upper ball housing and the lower ball seat. The locking bars are rotatably attached to the ball member, so that the ball member hold position relative to the upper ball housing and the lower ball seat, while still being able to rotate. The alignment to seal at the ceramic ring is maintained. Additionally, there are first and second supporting bars fixed to the lower housing and the upper ball housing. The supporting bars hold position of the upper ball housing relative to the lower housing, even as the connector sleeve and transition sleeve extend through the lower housing. The upper ball housing is stabilized for setting the ball member in the proper first or second ball member position. The supporting bars are offset from the locking bars and shifting bars. The supporting bars are not aligned with the locking bars and shifting bars and can be on opposite sides of different lateral sides of the ball member, such as ninety degrees away from the locking bars and shifting bars on the ball member.

Another embodiment includes the isolation valve assembly having a top sub, a wiper ring housing within the top sub, a collet housing engaging the top sub, a shifting sleeve collet, a sump sleeve, and a sump housing. The shifting sleeve collet has at least one collet cooperative with the collet housing. Setting the collet relative to the collet housing corresponds to movement of the shifting sleeve collet and the sump sleeve through the collet housing and sump housing. In this embodiment, the sump housing engages the lower housing, and the sump sleeve engages the transition sleeve. Thus, the position of the collet of the shift sleeve collet relative to the collet housing controls the actuation of the transition sleeve, and consequently, the actuation of the connector sleeve with the shifting bars. This embodiment shows a variation to rotate the ball member in a stable and supported manner uphole from the ball member.

Still another embodiment includes the isolation valve assembly having a spring retainer and a bottom sub downhole from the ball member. The spring retainer is mounted around the lower ball seat and is comprised of a spring and a lower piston. The spring retainer abuts the bottom sub to set the position of the lower ball seat relative to the bottom sub. Thus, the locking bars and supporting bars are stabilized relative to the bottom sub downhole from the ball member. The tension of the spring can maintain position of the ball member relative to the bottom sub, when the ball member rotates between the first and second ball member positions.

The invention also includes the method for isolating a zone in a wellbore with an isolation tool assembly. The isolation tool assembly is constructed and run into a wellbore in the opened configuration. The isolation tool assembly is set in a desired location between zones within the wellbore. Then, the ball member rotates from the second ball member position, corresponding to the opened configuration, to the first ball member position for the closed configuration. The ball member forms a barrier with the ceramic ring to seal each zone from each other. In one embodiment, the shifting bars engaged to corresponding shifting pins on the ball member move the shifting pins, which rotates the ball member. The locking bars and the supporting bars stabilize the ball member relative to the upper ball housing, the ceramic ring and lower ball seat housing, even though the ball member is rotating. With the embodiment of the isolation tool assembly with the top sub, shifting sleeve collet, collet housing, and sump sleeve, the method includes releasing a collet of the shifting sleeve collet to another collet position relative to the collet housing. The shifting sleeve collet moves the sump sleeve, which moves the transition sleeve. The transition sleeve moves the connector sleeve attached to the shifting bars. Thus, setting the collet position uphole controls the opened and closed configurations of the ball member further downhole on the isolation tool assembly. With the embodiment of the isolation tool assembly with the spring retainer and the bottom sub, the method includes setting the lower ball seat with the spring retainer between the locking shoulder of the lower ball seat and the bottom sub.

DETAILED DESCRIPTION OF THE INVENTION

Figure 1:
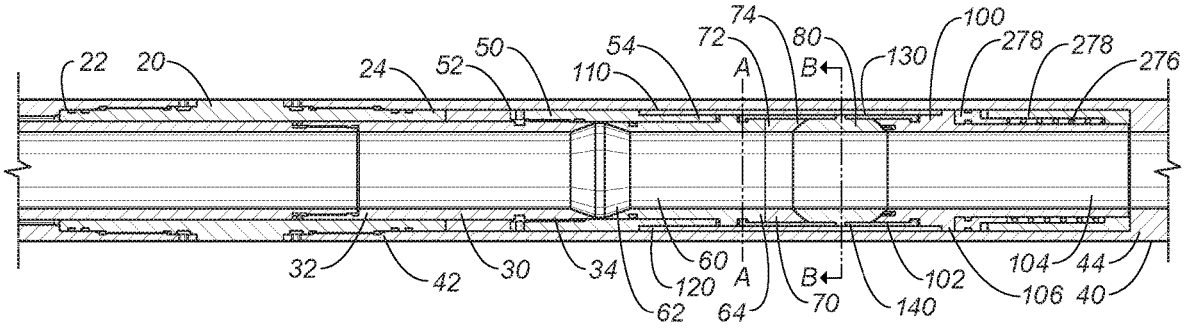
FIG. 1 is a longitudinal cross-sectional view of an embodiment of the isolation valve assembly in the opened configuration according to the present invention.

Referring to FIGS. 1-9, the isolation valve assembly 10 of the present invention can separate a production zone from a non-productive zone. A ball member 80 is the barrier between two zones, so that production fluids can be selectively delivered to the production zone in order to recover hydrocarbons from the production zone. The present invention rotates the ball member 80 between a closed configuration and an opened configuration by actuating shifting bars 110, 120. The ball member 80 is locked or held in place by the shifting bars 110, 120, the locking bars, 130, 140 and the supporting bars 150, 160 for a more secure and stable seal between zones.

Embodiments of the isolation valve assembly 10, according to the present invention in FIGS. 1-4, include a lower housing 20 having a first lower housing end 22 and a second lower housing end 24, and a transition sleeve 30 having a first transition sleeve end 32 and a second transition sleeve end 34. The second transition sleeve end 34 extends out of the second lower housing end 24. A bottom housing 40 has a first bottom housing end 42 and a second bottom housing end 44, and a connector sleeve 50 having a first connector sleeve end 52 and a second connector sleeve end 54. The first bottom housing end 42 engages the second lower housing end 24 of the lower housing 20, and the transition sleeve 30 extends into the bottom housing 40 from the first bottom housing end 42 and through the second lower housing end 24 of the lower housing 20. The bottom housing 40 is a tubular member, which houses other components, including a part of the lower housing and the entire connector sleeve 50. Within the bottom housing 40, the first connector sleeve end 52 engages the transition sleeve 30, and the second transition sleeve end 34 fixedly inserts into the first connector sleeve end 52. The transition sleeve 30 and the connector sleeve 50 are slideable within the bottom housing 40. The longitudinal movement of the connector sleeve 50 corresponds to longitudinal movement of the transition sleeve 30.

Figure 2:
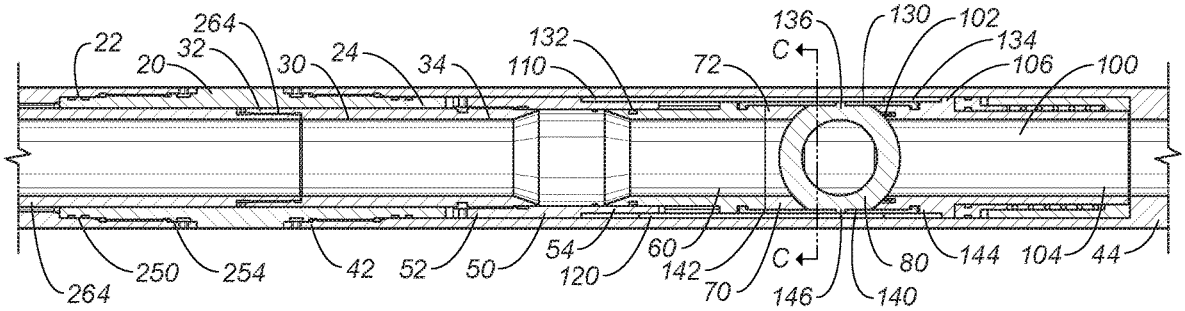
FIG. 2 is a longitudinal cross-sectional view of the embodiment of the isolation valve assembly in the closed configuration according to FIG. 1.

FIGS. 1-9 show embodiments of the isolation valve assembly 10 being further comprised of an upper ball housing 60 having a first upper ball housing end 62 and a second upper ball housing end 64, a ceramic ring 70 having a first ceramic ring end 72 and a second ceramic ring end 74, a ball member 80, and a lower ball seat 100 having a first lower ball seat end 102 and a second lower ball seat end 104. FIGS. 1-2 show that the first upper ball housing end 62 engages the second connector sleeve end 54. In particular, the first upper ball housing end 62 inserts into the second connector sleeve end 54 so that the longitudinal movement of the connector sleeve 50 is relative to the upper ball housing 60. The connector sleeve 50 is removable mounted around the first upper ball housing end 62. FIGS. 1-2 show a stop shoulder 66 on the upper ball housing 60. The stop shoulder 66 sets the position of the connector sleeve 50 relative to the upper ball housing 60, so how far the upper ball housing 60 inserts into the connector sleeve 50 can be set by the stop shoulder 66. The first ceramic ring end 70 engages the second upper ball housing end 64, and FIGS. 1-2 show an abutment as the type of engagement.

Figure 8:
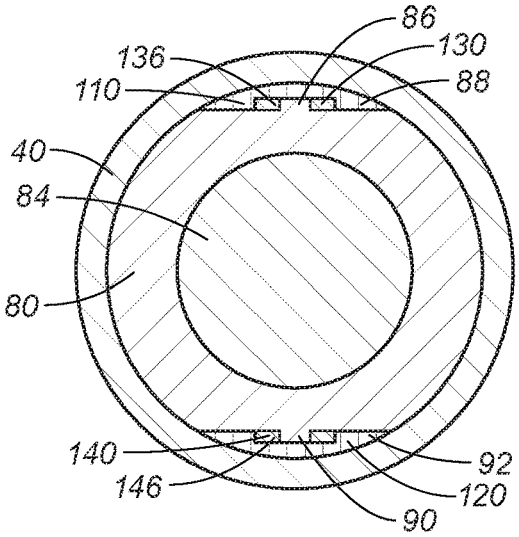
FIG. 8 is a cross-sectional view across Line B-B in FIG. 1.
Figure 9:
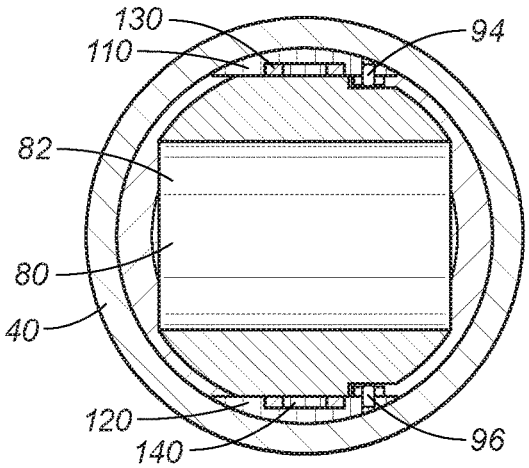
FIG. 9 is a cross-sectional view across Line C-C in FIG. 2.

FIGS. 8-9 show more detail to the ball member 80. In these embodiments, the ball member 80 comprises a ball body 82 having a through hole 84, a first axis member 86 and a first shifting pin 94 on a first lateral side 88 of the ball member, a second axis member 90 and a second shifting pin 96 on a second lateral side 92 of the ball member. The first axis member 86 is aligned with the second axis member 90 so that the axis of rotation of the ball member 80 is set by these axes 86, 88. The ball member 80 rotatably engages the first axis member 86 and the second axis member 88 cooperatively. The ball member 80 has a first ball member position corresponding to a closed configuration in FIG. 2 and a second ball member position corresponding to an opened configuration in FIG. 1.

In the closed configuration, the ball member 80 is in a sealed relationship to the ceramic ring 70. The ball body 82 engages the second ceramic ring end 74 to form a seal in FIGS. 2 and 9. In the opened configuration, the ball member 80 is in fluid connection with the ceramic ring 70 with the through hole 84 being aligned with the ceramic ring 70. Fluids can flow through the ball member 80, and there is no isolation of any zone. There is no barrier in this opened configuration of FIGS. 1 and 8.

FIG. 9 shows the embodiment with the first shifting pin 94 fixed on the first lateral side 88 of the ball member 80 and the second shifting pin 96 fixed on the second lateral side 92 of the ball member 80. FIG. 9 shows the closed configuration, although the ball member 80 is able to rotate between the first ball member position of FIG. 8 and the second ball member position of FIG. 9, according to position of the first shifting pin 94 to the first axis member 86 and position of the second shifting pin 96 to the second axis member 90, when the first and second shifting pins 94, 96 are cooperative. Thus, actuating the first and second shifting pins 94, 96 corresponds to rotating the ball member 80 between the first ball member position and the second ball member. Setting the position of the first and second shifting pins 94, 96 can lock the ball member 80 in either the closed or opened configuration.

FIGS. 1-2 show the lower ball seat 100 engaging the ball member 80 and being comprised of a locking shoulder 106. The first lower ball seat end 102 engages the ball member 80 corresponding to the relationship between the ball member 80 and the ceramic ring 70. In the closed configuration of FIG. 2, the first ball member position corresponds the ball member 80 in a sealed relationship to the lower ball seat 100. Particularly, the first lower ball seat end 102 can be in sealing engagement to the ball member 80 with the other side of the ball body 82 closing the lower ball seat 100 to fluid flow. In the opened configuration of FIG. 1, the second ball member position corresponds to the ball member 80 in fluid connection with the lower ball seat 100. Particularly, the first lower ball seat end 102 can be in fluid connection with the ball member 80.

Embodiments of FIGS. 3-7 show how the shifting bars 110, 120, locking bars, 130, 140, and supporting bars 150, 160 work in the isolation valve assembly 10 of the present invention. The first shifting bar 110 has a first shifting bar anchor end 112 and a first shifting bar slide end 114, and the second shifting bar 120 has a second shifting bar anchor end 122 and a second shifting bar slide end 124. Each shifting bar 110, 120 engages a respective shifting pin 94, 96 to actuate the ball member 80 between the first ball member position and the second bar member position. For example, the first shifting bar 110 engages the first shifting pin 94 and the second shifting bar 120 engages the second shifting pin 96. The movement of the shifting bars 110, 120 controls rotation of the ball member 80. FIGS. 1-6 show the first shifting bar anchor end 112 fixedly attached to the connector sleeve 50. The first shifting bar slide end 104 removably engages the lower ball seat 100, such as abutting the locking shoulder 106 in the opened configuration of FIG. 1 for the second ball member position. Since the second shifting bar 120 is cooperative with the first shifting bar 110, the second shifting bar 120 has also engages the second shifting pin 96. The second shifting bar slide end 124 removably engages the lower ball seat 100, such as abutting the locking shoulder 106. The second shifting bar anchor end 122 fixedly attaches to the connector sleeve 50 on an opposite side of the connector sleeve 50 from the first shifting bar 110, as seen in FIGS. 1, 2, 6 and 7. In particular, the opposite side can be the second lateral side 92 of the ball member 80, according to the second axis member 90 and second shifting pin 96.

Embodiments of the locking bars 130, 140, include the first locking bar 130 having an upper first locking bar end 132 and a lower first locking bar end 134 and being comprised of a first engagement means 136, such as a slot or indentation, to the first axis member 86 and the second locking bar 140 having an upper second locking bar end 142 and a lower second locking bar end 144, and being comprised of a second engagement means 146, such as a slot or indentation, to the second axis member 90. The second locking bar 140 is cooperative with the first locking bar 130, so that the locking bars 130, 140 work together on opposite sides of the ball member 80. FIGS. 1-2 show the upper first locking bar end 132 and the upper second locking bar end 142 fixedly attached to the upper ball housing 60, while the lower first locking bar end 134 and the lower second locking bar end 144 fixedly attach to the lower ball seat 100.

Figure 5:
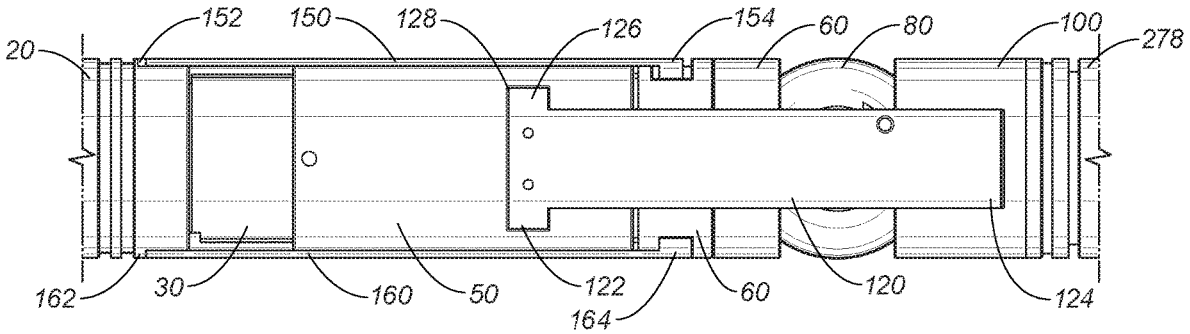
FIG. 5 is a top plan view of the embodiment of FIG. 1 in the opened configuration without the bottom housing.
Figure 6:
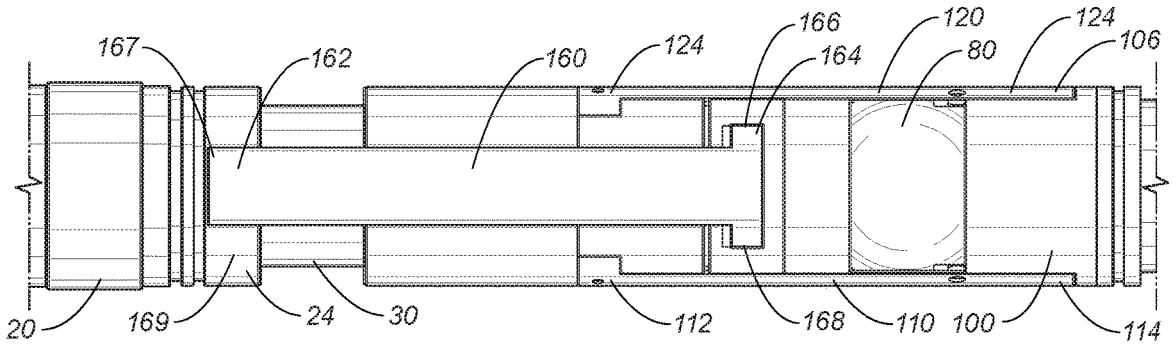
FIG. 6 is a side elevation view of the embodiment of FIG. 1 in the opened configuration without the bottom housing.
Figure 7:
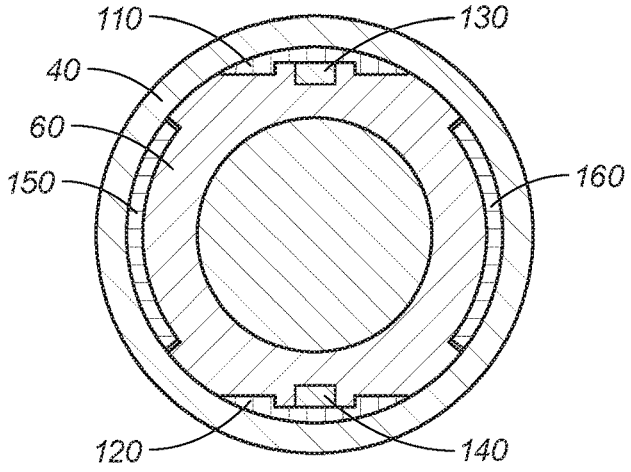
FIG. 7 is a cross-sectional view across Line A-A in FIG. 1.

FIGS. 3-7 also show the first supporting bar 150 having an upper first supporting bar end 152 and a lower first supporting bar end 154 and the second supporting bar 160 having an upper second supporting bar end 162 and a lower second supporting bar end 164. Similar to the other bars, the second supporting bar 160 is cooperative with the first supporting bar 150. The supporting bars 150, 160 are on opposite sides of the ball member 80, but the supporting bars 150, 160 are offset from the shifting bars 110, 120, as seen in FIGS. 3-7. FIG. 7 shows the offset as ninety degrees from the shifting bars 110, 120. FIG. 7 shows the relationship between the shifting bars 110, 120, locking bars, 130, 140, and supporting bars 150, 160 work in the isolation valve assembly 10 on the upper ball housing 60. FIGS. 3-6 show the upper first supporting bar end 152 and the upper second supporting bar 162 fixedly attached to the lower housing 20. The lower first supporting bar end 154 and the lower second supporting bar end 164 are fixedly attached to the upper ball housing 60.

In the present invention, the first and second shifting pins 94, 96 are actuated by respective first and second shifting bars 110, 120. The anchor ends 112, 122 of the shifting bars 110, 120 fixedly attach to the connector sleeve 50 so that the shifting bars 110, 120 move with the connector sleeve 50 and transition sleeve 30. Thus, the ball member 80 rotates according to movement of the connector sleeve 50 and transition sleeve 30. FIGS. 7 and 8 show the locking bars 130, 140 rotatably attached to the ball member 80, so that the ball member 80 hold position relative to the upper ball housing 60 and the lower ball seat 100, while still being able to rotate. The alignment to seal at the ceramic ring is maintained. FIG. 7 shows first and second supporting bars 150, 160 to hold position of the upper ball housing 60 relative to the lower housing 20, even as the connector sleeve 50 and transition sleeve 30 extend through the lower housing 20. The upper ball housing 60 is stabilized for setting the ball member 80 in the proper first or second ball member position.

Figure 3:
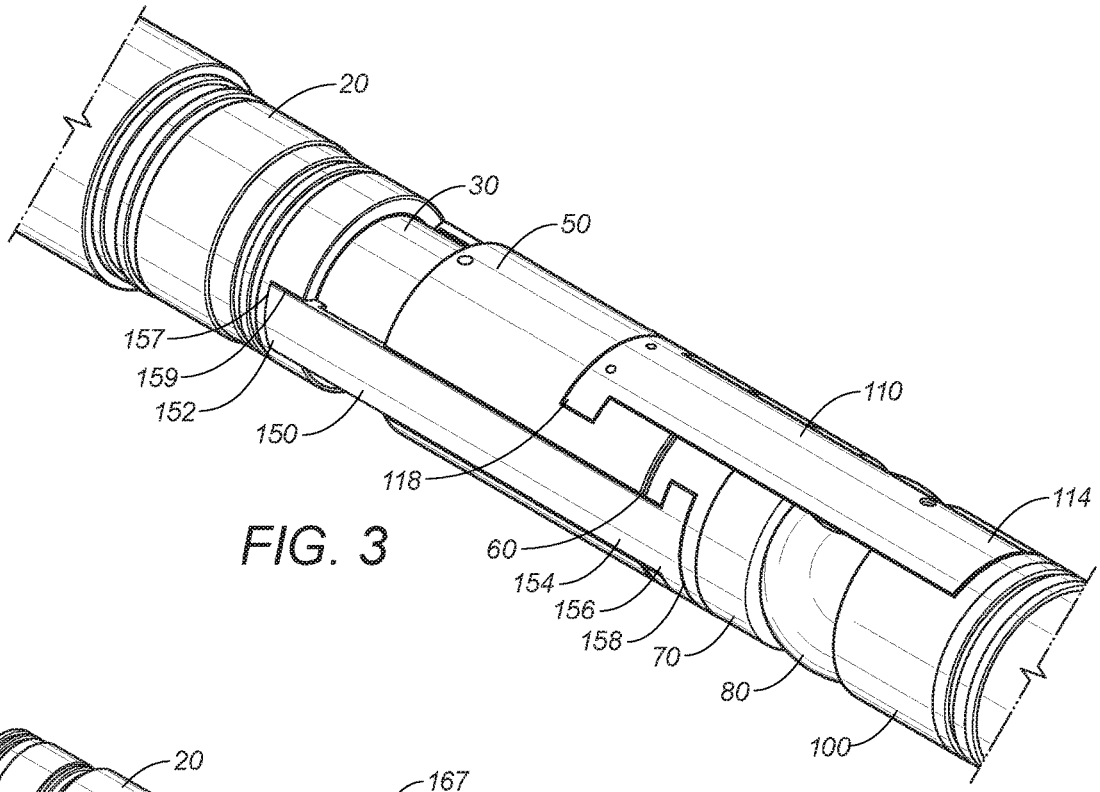
FIG. 3 is an exploded perspective view of the embodiment of FIG. 1 in the opened configuration without the bottom housing.
Figure 4:
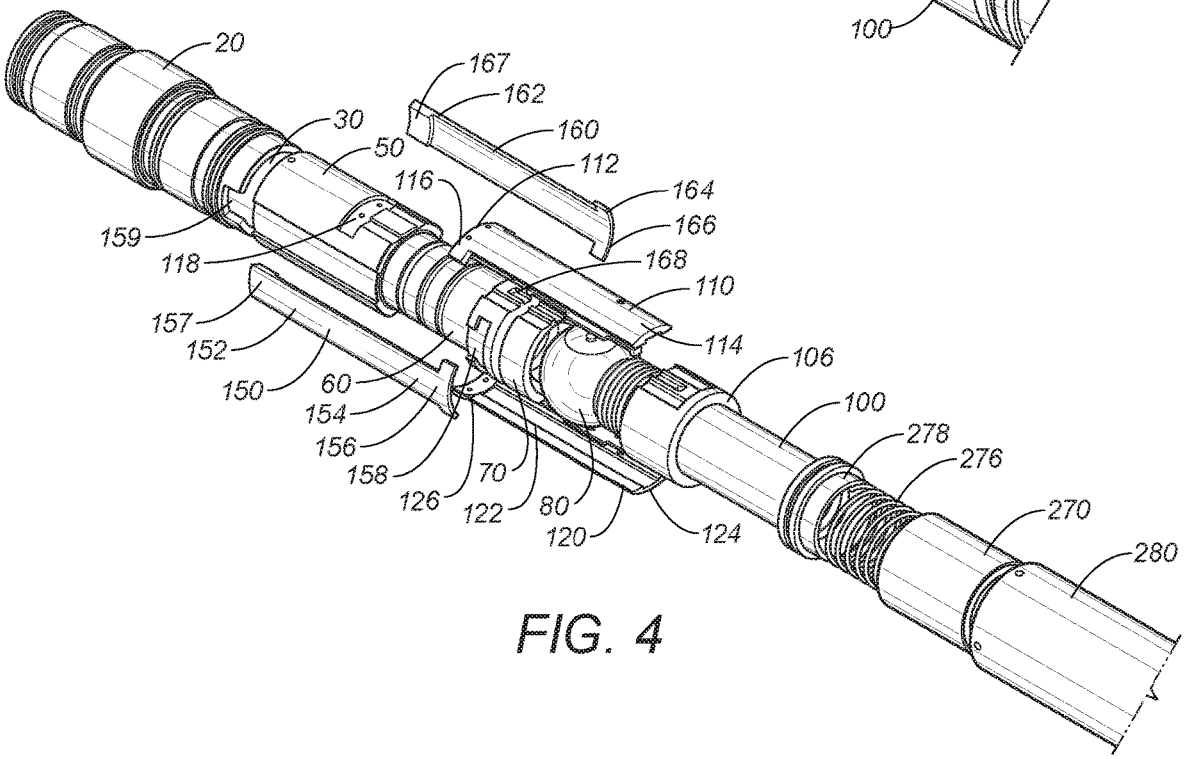
FIG. 4 is a perspective view of the embodiment of FIG. 1 in the opened configuration without the bottom housing.

FIGS. 1-6 show various embodiments of the shifting bars 110, 120, locking bars, 130, 140, and supporting bars 150, 160. FIGS. 3-5 show the first shifting bar anchor end 112 and the second shifting bar anchor end 122 attached to the connector sleeve 50 at the second connector sleeve end 54. The first shifting bar anchor end 112 has a T-shape 116 and the second shifting bar anchor end has a T-shape 126. The second connector sleeve end 54 has complementary cavities 118, 128 to fit the T-shapes 116, 126. The T-shapes 116, 126 provide locking surfaces for the stable connections and friction fit engagement between the shifting bars 110, 120 and the connector sleeve 50. FIGS. 3, 4 and 6 show a similar relationship between the supporting bars 150, 160 and the lower housing 20. The upper first supporting bar end 152 and the upper second supporting bar end 162 fixedly attach to the second lower housing end 24 of the lower housing 20. The upper first supporting bar end 152 is comprised of a lug 157, and the upper second supporting bar end 162 is comprised of a lug 167. Thus, the lower housing 20 has complementary indentations 159, 169 to fixedly engage the corresponding lugs 157, 167. The embodiments further show the lower first supporting bar end 154 and the lower second supporting bar end 164 fixedly attached to the second upper ball housing end 64 of the upper ball housing 60. In some versions, the lower first supporting bar end 154 and the lower second supporting bar end 164 each have a T-shape 156, 166 to engage complementary cavities 158, 168 in the upper ball housing 60. The locking bars 120, 130 already fixedly attach the upper ball housing 60 to the lower ball seat 100. The T-shapes 156, 166 also provide locking surfaces for the stable connections and friction fit engagement between the supporting bars 150, 160 and the upper ball housing 60. Additionally, the T-shapes 156, 166 have an opposite orientation to the T-shapes 116, 126 so that the locking surfaces oppose each other for more stability of the shifting bars 110, 120, locking bars, 130, 140, and supporting bars 150, 160.

Figure 10:
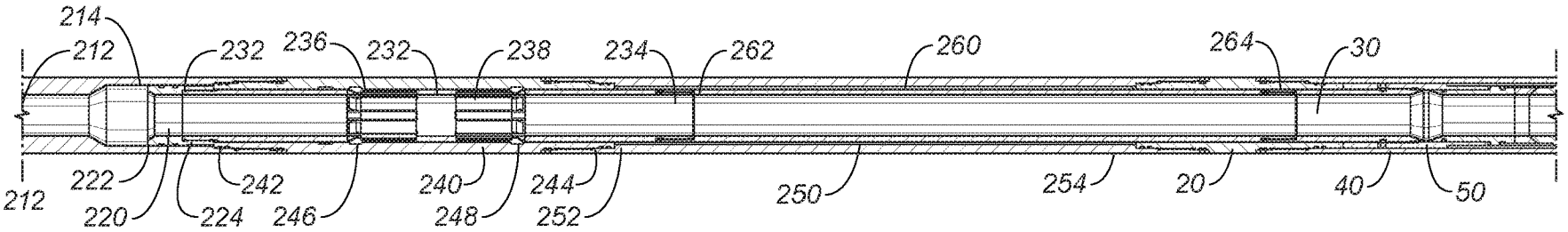
FIG. 10 is a longitudinal cross-sectional view of another embodiment of the isolation valve assembly in the closed configuration with the shifting collet sleeve and the collet housing.

Referring to FIG. 10, there is an alternate embodiment of the isolation tool assembly 10 with control of the ball member 80 uphole on the isolation tool assembly 10. FIG. 10 is an example of controlling the ball member 80 through the shifting pins 94, 96, shifting bars 110, 120, the connector sleeve 50, and the transition sleeve 30. In this embodiment, shown in the closed configuration, there is a top sub 210 having a first top sub end 212 and a second top sub end 214, a wiper ring housing 220 within the second top sub end 214, a shifting sleeve collet 230 having a first shifting sleeve end 232 and a second shifting sleeve end 234, a collet housing 240 having a first collet housing end 242 and a second collet housing end 244, a sump housing 250 having a first sump housing end 252 and a second sump housing end 254, and a sump sleeve 260 having a first sump sleeve end 262 and a second sump sleeve end 264.

The wiper ring housing 220 is positioned within the second top sub end 214 of the top sub 210. The first shifting sleeve end 232 inserts into the second top sub end 214 also and abuts the wiper ring housing 220. The wiper ring housing 220 has a first wiper ring end 222 and a second wiper ring end 224 opposite the first wiper ring end. The shifting sleeve collet 230 extends through the collet housing 240 to engage the sump sleeve 260. FIG. 10 shows that the first sump sleeve end 262 engages the second shifting sleeve end 234. The sump sleeve 260, in particular, the second sump sleeve end 264, engages the transition sleeve 30 of FIGS. 1-6. The first transition sleeve end 32 engages the second sump sleeve end 264 in FIG. 10. Thus, movement of the shifting sleeve collet 230 can be used to control the ball member 80 uphole on the isolation tool assembly 10.

Similarly, the top sub 210 engages the collet housing 240, and the collet housing 240 engages the sump housing 250 so that a housing component encases a sleeve component within the isolation tool assembly 10. The sump housing 250 engages the lower housing 20 of FIGS. 1-6. The first lower housing end 22 engages the second sump housing end 254. In FIG. 10, the sump housing 250 is fixedly attached to the collet housing 240 with the first sump housing end 252 engaging the collet housing 240 opposite the top sub 210.

FIG. 10 also shows the shifting sleeve collet 230 comprised of a first collet 236 and a second collet 238 between the first shifting sleeve end 232 and the second shifting sleeve end 234. The collet housing 240 is comprised of a first collet engagement means 246 and a second collet engagement means 248. The shifting sleeve collet 230 has a first collet position corresponding to the first collet 236 removably attached to the first collet engagement means 246 and a second collet position corresponding to the second collet 238 removably attached to the second collet engagement means 248. In this embodiment, the first collet 236 removably attached to the first collet engagement means 246 in the first collet position corresponds to the opened configuration of the ball member 80 of FIG. 1. The second collet 238 removably attached to the second collet engagement means 248 in the second collet position corresponds to the closed configuration of the ball member 80 of FIGS. 2 and 10. Actuating the shifting sleeve collet 230 with the collets 236, 238 can control the ball member 80 in this embodiment. There is uphole control of the ball member 80 on the isolation tool assembly 10. FIG. 10 shows the first collet 236 having an orientation opposite the second collet 238, so narrowing collets 236, 238 can move the shifting sleeve collet 230 back and forth along the axis of the isolation tool assembly 10. The collets 236, 238 are facing each other in the embodiment, but the collets 236, 238 may also face away from each other.

The first collet engagement means 246 and the second collet engagement means 248 includes an indentation, a ring, and a ring with a stop shoulder and a sloped shoulder. FIG. 10 shows the embodiment with the ring with the stop shoulder and sloped shoulder. Each collet 236, 238 can move over a respective slope shoulder and can be friction fit against the respective stop shoulder. The embodiment is a friction fit or snap fit engagement of the collets 236, 238 to the collet housing 240. The shifting sleeve collet 230 can be snap fit into the collet housing 240 back and forth for opening and closing the ball member 80.

In the context of FIG. 10, the first shifting bar slide end 114 and the second shifting bar slide end 124 abut the locking shoulder 106 of the lower ball seat 100 in the opened configuration and in the first collet position. The upper first supporting bar end 152 and the upper second supporting bar end 162 fixedly attach to the lower housing 20 in the opened configuration and in the first collet position, while the lower first supporting bar end 154 and the lower second supporting bar end 164 fixedly attach to the upper ball housing 60.

In the closed configuration of the ball member 80 related to the second collet position of the shifting sleeve collet 230, the first connector sleeve end 52 abuts the lower housing 20 with the first shifting bar slide end 114 and the second shifting bar slide end 124 separated or displaced from the locking shoulder 106, according to position of the connector sleeve 50. The upper first supporting bar end 152 and the upper second supporting bar end 162 still fixedly attach to the lower housing 20, while the lower first supporting bar end 154 and the lower second supporting bar end 164 still fixedly attach to the upper ball housing 60. The isolation tool assembly 10 stabilizes the ball member 80 by the offset supporting bars 150, 160, in both opened and closed configurations of the ball member 80 and the different positions of the shifting bars 110, 120. The stability is not dependent on the shifting bars 110, 120.

Figure 11:
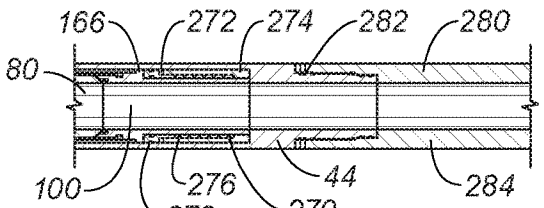
FIG. 11 is a longitudinal cross-sectional view of still another embodiment of the isolation valve assembly in the closed configuration with the spring retainer and bottom sub.

Referring to FIG. 11, there is an alternate embodiment of the isolation tool assembly 10 with control of the ball member 80 downhole on the isolation tool assembly 10. In this embodiment, components of the isolation tool assembly 10 support the stable position of the lower ball seat 100. FIG. 11 shows a spring retainer 270 having a first spring retainer end 272 and a second spring retainer end 274, and a bottom sub 280 having a first bottom sub end 282 and a second bottom sub end 284. The spring retainer 270 is mounted around the second lower ball seat end 104 and within the bottom housing 40. In particular, the second spring retainer end 274 abuts the second bottom housing end 44 from inside the bottom housing 40. The first bottom sub end 282 engages the second bottom housing end 44 so that components are contained within the bottom housing 40, and the lower housing 20. In other embodiments, there is the sump housing 250 and collet housing 240 for attaching to the top sub 210. In this manner, the isolation valve assembly 10 has an exterior of the top sub 210, collet housing 240, sump housing 250, lower housing 20, bottom housing 40 and bottom sub 270.

FIG. 11 further shows that the spring retainer 270 can be comprised of a spring 276 and a lower piston 278. The spring 276 is mounted around the second bottom housing end 44 and between the second spring retainer end 274 and the lower piston 278. The lower piston 278 is mounted around the second bottom housing end 44 and between the first spring retainer end 272 and the locking shoulder 106 of the lower ball seat 100. The second lower ball seat end 104 extends through the spring retainer 270 and abuts the second bottom housing end 44. The lower ball seat 100 is resilient, as the spring 276 maintains the position of the lower ball seat 100, when the shifting bars 110, 120 actuate and when the ball member 80 rotates. The locking bars 130, 140 and the supporting bars 150, 160 are stabilized relative to the bottom sub 280 with the lower ball seat 100 held in place. As the locking bars 130, 140 and the supporting bars 150, 160 are held together, the seal of the ball member 80 on the ceramic ring 70 is more stable. The actuation of the shifting bars 110, 120 can rotate the ball member 80, while other non-moving components lock the seal and rotation of the ball member 80.

FIGS. 1-2 also show the embodiment of the method for isolating a zone in a wellbore with an isolation tool assembly. The method includes assembling the components to form the isolation tool assembly 10 and running the isolation tool assembly 10 to a desired location in a wellbore. The ball member 80 is set in the second ball member position corresponding to an opened configuration. Fluid can flow through the isolation tool assembly 10 when deployed. Then, the isolation tool assembly 10 is set at the desired location between zones within the wellbore. The ball member 80 is actuated from the second ball member position to the first ball member position corresponding to a closed configuration. Each zone is now sealed from each other at the barrier formed by the ball member 80.

The step of actuating the ball member 80 includes actuating the ball member 80 by rotating the ball member 80. The method with the shifting bars 110, 120, locking bars, 130, 140, and supporting bars 150, 160 includes moving the first shifting bar 110 and the second shifting bar 120 from positions corresponding to the second ball member position to another position corresponding to the first ball member position. The first shifting bar 110 actuates the first shifting pin 94 on the ball member 80, and the second shifting bar 120 actuates the second shifting pin 96 on the ball member 80. The second shifting bar 120 is cooperative with the first shifting bar 110 to rotate the ball member 80. The supporting bars 150, 160 attached to the lower housing 20 and the upper ball housing 40 and the locking bars 130, 140 attached to the upper ball housing 40 and the lower ball seat 100 stabilize the ball member 80.

In embodiments of the isolation tool assembly 10 with the uphole components, including the shifting sleeve collet 230, the collet housing 240, the sump housing 250, and the sump sleeve 260, the method includes releasing the first collet 236 in the first collet position and setting the second collet 238 in the second collet position for the step of moving the shifting bars 110, 120 from a position corresponding to the second ball member position to another position corresponding to the first ball member position. In this embodiment, the first collet 236 in the first collet position on the collet housing 240 corresponds to the opened configuration and the second ball member position, when the isolation valve tool assembly 10 is being run into the wellbore. The shifting sleeve collet 230 moves with the shifting bars 110, 120 and locks position with the first and second collets 236, 238.

In embodiments of the isolation tool assembly 10 with the downhole components, including the spring retainer 270 and the bottom sub 280, the method includes setting the locking shoulder 106 of the lower ball seat 100 by the lower piston 278 and the spring 276 of the spring retainer 270. The downhole components resiliently hold the position of the lower ball seat 100 so that the locking bars 130, 140 and supporting bars 150, 160 are similarly stabilized to hold, while the shifting bars 110, 120 actuate the ball member 80. The shifting bars 110, 120 are no longer solely responsible for stability and locking of the ball member 80.

The present invention is an isolation valve assembly for separating zones in a wellbore. The ball member rotates between a first ball member position corresponding to a closed configuration and a second ball member position corresponding to an opened configuration. The relationships could also be reversed with the first ball member position corresponding to the opened configuration. The shifting bars actuate shifting pins to rotate the ball member and to hold the position of the ball member. In the present invention, additional locking bars and supporting bars are used to lock and stabilize the ball member. Stopping rotation of the ball member is important to maintain the seal in the closed configuration, and the present invention no longer relies on only the shifting bars to lock the rotation. The shifting bars are held in place by the supporting bars, and the locking bars hold both the shifting bars and ball member in place. The supporting bars are offset from the shifting bars relative to the ball member. The supporting bars are rotated ninety degrees around the ball member from the set of shifting bars, so both sides of the ball member at two different orientations are supported.

Additionally, the supporting bars are anchored to different components than the shifting bars. The supporting bars do not move with the shifting bars, so the stability of the supporting bars is independent from the actuation of the shifting bars. In particular, the supporting bars connect the lower housing and the upper ball housing, while the shifting bars anchor to the connector sleeve and slide against the lower ball seat. The present invention prevents the connector sleeve and shifting bars from dislocating the upper ball housing and the stability of the ball member engaging the upper ball housing through the ceramic ring is not affected by the movement of the shifting bar and connector sleeve. The offset and separation of the supporting bars from the shifting bars enable a more resilient and reliable seal at the ball member for isolating zones in a wellbore.

The foregoing disclosure and description of the invention is illustrative and explanatory thereof. Various changes in the details of the illustrated structures, construction and method can be made without departing from the true spirit of the invention.

We claim:

1. An isolation valve assembly, comprising:

a lower housing having a first lower housing end and a second lower housing end;

a transition sleeve having a first transition sleeve end and a second transition sleeve end, said second transition sleeve end extending out of said second lower housing end;

a bottom housing having a first bottom housing end and a second bottom housing end, said first bottom housing end engaging said second lower housing end of said lower housing, said transition sleeve extending into said bottom housing from said first bottom housing end and extending through said second lower housing end, a connector sleeve having a first connector sleeve end and a second connector sleeve end and being positioned within said bottom housing, said first connector sleeve end engaging said transition sleeve, said second transition sleeve end being fixedly inserted into said first connector sleeve end, wherein longitudinal movement of said connector sleeve corresponds to longitudinal movement of said transition sleeve;

an upper ball housing having a first upper ball housing end and a second upper ball housing end and being within said bottom housing, said first upper ball housing end engaging said second connector sleeve end, said first upper ball housing end being inserted into said second connector sleeve end;

a ceramic ring having a first ceramic ring end and a second ceramic ring end, said first ceramic ring end engaging said second upper ball housing end;

a ball member comprising:

a ball body having a through hole;

a first axis member on a first lateral side of said ball member;

a second axis member on a second lateral side of said ball member, said first axis member being aligned with said second axis member, wherein said ball member is rotatably engaged to said first axis member and said second axis member, said first axis being cooperative with the said second axis member, wherein a first ball member position corresponds to a closed configuration with said ball member in a sealed relationship to said ceramic ring, said ball body engaging said second ceramic ring end, and wherein a second ball member position corresponds to an opened configuration with said ball member in fluid connection with said ceramic ring, said through hole being aligned with said ceramic ring a first shifting pin fixed on said first lateral side of said ball member, said ball member actuating between said first ball member position and said second ball member position according to the position of said first shifting ring relative to said ceramic ring; and a second shifting pin fixed on said second lateral side of said ball member, said second shifting pin being cooperative with said first shifting pin, said ball member actuating between said first ball member position and said second ball member position according to the position of said second shifting ring relative to said ceramic ring; and wherein said ball member is actuatable between said first ball member position and said second ball member position cooperative with said first shifting pin;

a lower ball seat having a first lower ball seat end and a second lower ball seat end, said first lower ball set end engaging said ball member, said lower ball seat being comprised of a locking shoulder, wherein said first ball member position corresponds to said closed configuration with said ball member in a sealed relationship to said lower ball seat, said first lower ball seat end in sealing engagement to said ball member, wherein said second ball member position corresponds to said opened configuration with said ball member in fluid connection with said lower ball seat, said first lower ball seat end in fluid connection with said ball member;

a first shifting bar being comprised of a first shifting bar anchor end and a first shifting bar slide end, said first shifting bar engaging said first shifting pin so as to actuate said ball member between said first ball member position and said second ball member position according to the position of said first shifting bar, wherein said first shifting bar anchor end fixedly attaches to said connector sleeve, and wherein said first shifting bar slide end removably engages said lower ball seat according to said position of said first shift bar and said ball member between said first ball member position and said second ball member position;

a second shifting bar being comprised of a second shifting bar anchor end and a second shifting bar slide end, said second shifting bar engaging said second shifting pin so as to actuate said ball member between said first ball member position and said second ball member position according to the position of said second shifting bar, said second shifting bar being cooperative with said first shifting bar, wherein said second shifting bar anchor end fixedly attaches to said connector sleeve on an opposite side of said connector sleeve from said first shifting bar, and wherein said second shifting bar slide end removably engages said lower ball seat according to said position of said second shift bar and said ball member between said first ball member position and said second ball member position;

a first locking bar having an upper first locking bar end and a lower first locking bar end and being comprised of a first engagement means to said first axis member, wherein said upper first locking bar end fixedly attaches to said upper ball housing, and wherein said lower first locking bar end fixedly attaches to said lower ball seat;

a second locking bar having an upper second locking bar end and a lower second locking bar end, said second locking bar being cooperative with said first locking bar and being comprised of a second engagement means to said second axis member, wherein said upper second locking bar end fixedly attaches to said upper ball housing, and wherein said lower second locking bar end fixedly attaches to said lower ball seat;

a first supporting bar having an upper first supporting bar end and a lower first supporting bar end, wherein said upper first supporting bar end fixedly attaches to said lower housing, and wherein said lower first supporting bar end fixedly attaches to said upper ball housing; and a second supporting bar having an upper second supporting bar end and a lower second supporting bar end, said second supporting bar being cooperative with said first supporting bar, wherein said upper second supporting bar end fixedly attaches to said lower housing, wherein said lower second supporting bar end fixedly attaches to said upper ball housing, and wherein said first shifting bar and said second shifting bar are offset from said first supporting bar and said second supporting bar.

2. The isolation valve assembly, according to claim 1, wherein said first shifting bar anchor end attaches to said connector sleeve at said bottom connector sleeve end.

3. The isolation valve assembly, according to claim 2, wherein said first shifting bar anchor end has a T-shape, said bottom connector sleeve having a complementary cavity to fixedly engage said T-shape of said first shifting bar anchor end.

4. The isolation valve assembly, according to claim 1, wherein said second shifting bar anchor end attaches to said connector sleeve at said bottom connector sleeve end.

5. The isolation valve assembly, according to claim 4, wherein said second shifting bar anchor end has a T-shape, said bottom connector sleeve having a complementary cavity to fixedly engage said T-shape of said second shifting bar anchor end.

6. The isolation valve assembly, according to claim 1, wherein said upper first supporting bar end fixedly attaches to said second lower housing end of said lower housing, and wherein said lower first supporting bar end fixedly attaches to said second upper ball housing end of said upper ball housing.

7. The isolation valve assembly, according to claim 6, wherein said lower first supporting bar end has a T-shape, said upper ball housing having a complementary cavity to fixedly engage said T-shape of said lower first supporting bar end.

8. The isolation valve assembly, according to claim 6, wherein said upper first supporting bar end is comprised of a lug, said lower housing having a complementary indentation to fixedly engage said lug.

9. The isolation valve assembly, according to claim 1, wherein said upper second supporting bar end fixedly attaches to said second lower housing end of said lower housing, and wherein said lower second supporting bar end fixedly attaches to said second upper ball housing end of said upper ball housing.

10. The isolation valve assembly, according to claim 9, wherein said lower second supporting bar end has a T-shape, said upper ball housing having a complementary cavity to fixedly engage said T-shape of said lower second supporting bar end.

11. The isolation valve assembly, according to claim 9, wherein said upper second supporting bar end is comprised of a lug, said lower housing having a complementary indentation to fixedly engage said lug.

12. The isolation valve assembly, according to claim 1, further comprising:

a top sub having a first top sub end and a second top sub end;

a wiper ring housing within said second top sub end;

a shifting sleeve collet having a first shifting sleeve end and a second shifting sleeve end, and being comprised of a first collet and a second collet between said first shifting sleeve end and said second shifting sleeve end;

a collet housing having a first collet housing end and a second collet housing end, engaging said top sub, and being comprised of a first collet engagement means and a second collet engagement means, said shifting sleeve collet extending through said collet housing, wherein a first collet position corresponds to said first collet removably attached to said first collet engagement means, and wherein a second collet position corresponding to said second collet removably attached to said second collet engagement means;

a sump housing having a first sump housing end and a second sump housing end, said sump housing being fixedly attached to said collet housing, said first sump housing end engaging said collet housing opposite said top sub; and a sump sleeve having a first sump sleeve end and a second sump sleeve end, said first sump sleeve end engaging said second shifting sleeve end, said sump sleeve extending through said sump housing, wherein said first lower housing end engages said second sump housing end, wherein said first transition sleeve end engages said second sump sleeve end, and wherein said first collet removably attached to said first collet engagement means in said first collet position corresponds to said opened configuration of said ball member, and wherein a second collet removably attached to said second collet engagement means in said second collet position corresponding to said closed configuration of said ball member.

13. The isolation valve assembly, according to claim 12, wherein said first collet has an orientation opposite said second collet.

14. The isolation valve assembly, according to claim 12, wherein said first shifting bar slide end abuts said locking shoulder of said lower ball seat in said opened configuration and in said first collet position, wherein said upper first supporting bar end fixedly attaches to said lower housing in said opened configuration and in said first collet position, wherein said lower first supporting bar end fixedly attaches to said upper ball housing in said opened configuration and in said first collet position, wherein said second shifting bar slide end abuts said locking shoulder of said lower ball seat in said opened configuration and in said first collet position, wherein said upper second supporting bar end fixedly attaches to said lower housing in said opened configuration and in said first collet position, wherein said lower second supporting bar end fixedly attaches to said upper ball housing in said opened configuration and in said first collet position, wherein said first connector sleeve end abuts said lower housing in said closed configuration and in said second collet position, said first shifting bar slide end being displaced according to the position of said connector sleeve, said second shifting bar slide end being displaced according to the position of said connector sleeve, wherein said upper first supporting bar end fixedly attaches to said lower housing in said closed configuration and in said second collet position, wherein said lower first supporting bar end fixedly attaches to said upper ball housing in said closed configuration and in said second collet position, wherein said upper second supporting bar end fixedly attaches to said lower housing in said closed configuration and in said second collet position, and wherein said lower second supporting bar end fixedly attaches to said upper ball housing in said closed configuration and in said second collet position.

15. The isolation valve assembly, according to claim 1, further comprising:

a spring retainer having a first spring retainer end and a second spring retainer end, said spring retainer being mounted around said second lower ball seat end and within said bottom housing, said second spring retainer end abutting said second bottom housing end, wherein said spring retainer is comprised of a spring and a lower piston, said spring being mounted around said second bottom housing end and between said second spring retainer end and said lower piston, said lower piston being mounted around said second bottom housing end and between said first spring retainer end and said locking shoulder of said lower ball seat; and a bottom sub having a first bottom sub end and a second bottom sub end, said first bottom sub end engaging said second bottom housing end.

16. The isolation valve assembly, according to claim 15, wherein said second lower ball seat end extends through said spring retainer and abuts said second bottom housing end of said bottom housing.

17. A method for isolating a zone in a wellbore, the method comprising the steps of:

forming an isolation valve assembly, according to claim 1;

running said isolation valve assembly, with said ball member in said second ball member position, to a desired location in a wellbore, said second ball member position corresponding to said opened configuration;

setting said isolation valve assembly in the desired location between zones within said wellbore;

actuating said ball member from said second ball member position to said first ball member position, said first ball member position corresponding to said closed configuration; and sealing each zone from each other.

18. The method for isolating, according to claim 17, wherein the step of actuating said ball member comprises the steps of:

moving said first shifting bar from a position corresponding to said second ball member position to another position corresponding to said first ball member position, said first shifting bar actuating said first shifting pin;

moving said second shifting bar from a position corresponding to said second ball member position to another position corresponding to said first ball member position, said second shifting bar actuating said second shifting pin, said second shifting bar being cooperative with said first shifting bar;

stabilizing said ball member with said first supporting bar fixedly attached to said lower housing and said upper ball housing.

19. The method for isolating, according to claim 18, wherein said isolation valve assembly further comprises:

a top sub having a first top sub end and a second top sub end;

a wiper ring housing within said second top sub end;

a shifting sleeve collet having a first shifting sleeve end and a second shifting sleeve end, and being comprised of a first collet and a second collet between said first shifting sleeve end and said second shifting sleeve end;

a collet housing having a first collet housing end and a second collet housing end and being comprised of a first collet engagement means and a second collet engagement means, said shifting sleeve collet extending through said collet housing, wherein a first collet position corresponds to said first collet removably attached to said first collet engagement means, and wherein a second collet position corresponding to said second collet removably attached to said second collet engagement means;

a sump housing having a first sump housing end and a second sump housing end, said sump housing being fixedly attached to said collet housing, said first sump housing end engaging said collet housing opposite said top sub; and a sump sleeve having a first sump sleeve end and a second sump sleeve end, said first sump sleeve end engaging said second shifting sleeve end, said sump sleeve extending through said sump housing, wherein said first lower housing end engages said second sump housing end, wherein said first transition sleeve end engages said second sump sleeve end, and wherein said first collet removably attached to said first collet engagement means in said first collet position corresponds to said opened configuration of said ball member, wherein a second collet removably attached to said second collet engagement means in said second collet position corresponding to said closed configuration of said ball member, and wherein the step of moving said first shifting bar from a position corresponding to said second ball member position to another position corresponding to said first ball member position comprises:

releasing said first collet in said first collet position; and setting said second collet in said second collect position.

20. The method for isolating, according to claim 19, wherein said isolation valve assembly further comprises:

a spring retainer having a first spring retainer end and a second spring retainer end, said spring retainer being mounted around said second lower ball seat end and within said bottom housing, said second spring retainer end abutting said second bottom housing end, wherein said spring retainer is comprised of a spring and a lower piston, said spring being mounted around said second bottom housing end and between said second spring retainer end and said lower piston, said lower piston being mounted around said second bottom housing end and between said first spring retainer end and said locking shoulder of said lower ball seat; and a bottom sub having a first bottom sub end and a second bottom sub end, said first bottom sub end engaging said second bottom housing end, and wherein the method further comprises the step of:

setting said locking shoulder of said lower ball seat by said lower piston and said spring of said spring retainer.

* * * * *